US008147272B2

(12) United States Patent
Rhein

(10) Patent No.: US 8,147,272 B2
(45) Date of Patent: Apr. 3, 2012

(54) HEADER CONNECTOR ASSEMBLY

(75) Inventor: David James Rhein, Memphis, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/700,181

(22) Filed: Feb. 4, 2010

(65) Prior Publication Data

US 2011/0189888 A1 Aug. 4, 2011

(51) Int. Cl.
*H01R 13/73* (2006.01)

(52) U.S. Cl. ..... 439/556; 439/607.28

(58) Field of Classification Search ..... 439/556, 439/939, 559, 504, 701, 607.28
See application file for complete search history.

(56) References Cited

U.S. PATENT DOCUMENTS

| | | | | |
|---|---|---|---|---|
| 3,094,364 | A * | 6/1963 | Liagg | 439/247 |
| 3,951,500 | A * | 4/1976 | Anderson | 439/248 |
| 5,588,858 | A * | 12/1996 | Lester et al. | 439/275 |
| 5,641,294 | A * | 6/1997 | Beard | 439/247 |
| 5,728,974 | A * | 3/1998 | Kitoh et al. | 174/658 |
| 5,997,349 | A | 12/1999 | Yoshioka | |
| 6,042,396 | A | 3/2000 | Endo et al. | |
| 6,607,308 | B2 * | 8/2003 | Dair et al. | 385/92 |
| 7,063,563 | B1 * | 6/2006 | Hsu | 439/527 |
| 7,214,080 | B2 * | 5/2007 | Ichio et al. | 439/248 |
| 7,344,413 | B2 | 3/2008 | Nishida | |
| 7,494,374 | B2 * | 2/2009 | Hall et al. | 439/564 |
| 7,588,466 | B2 * | 9/2009 | Blasko et al. | 439/620.09 |
| 7,591,678 | B2 * | 9/2009 | Ikeya et al. | 439/557 |
| 7,621,777 | B2 * | 11/2009 | Thelen | 439/559 |
| 7,753,732 | B2 * | 7/2010 | Kameyama et al. | 439/607.27 |
| 2002/0155756 | A1 | 10/2002 | Yoshioka | |
| 2003/0082937 | A1 | 5/2003 | Burdick | |
| 2006/0205250 | A1 | 9/2006 | Dickson | |

FOREIGN PATENT DOCUMENTS

| | | | |
|---|---|---|---|
| DE | 198 48 622 | A1 | 5/1999 |
| EP | 0 355 276 | A1 | 2/1990 |

OTHER PUBLICATIONS

International Search Report, International Application No. PCT/US2011/000128, International Filing Date Jan. 24, 2011.

* cited by examiner

*Primary Examiner* — Neil Abrams
*Assistant Examiner* — Harshad C Patel

(57) ABSTRACT

A header connector assembly includes an outer housing, an inner housing, a shield subassembly, and a seal body. The outer housing is disposed in an opening of a panel and includes a cavity. The inner housing includes a channel and is disposed in the opening of the panel. The inner housing is received in the cavity of the outer housing and includes a channel configured to have a contact disposed therein. The shield subassembly is disposed between the outer housing and the inner housing. The shield subassembly engages the panel to electrically couple the shield subassembly with the panel. The seal body is disposed between the panel and at least one of the outer housing and the inner housing. The seal body restricts passage of contaminants between the panel and at least one of the outer housing and the inner housing.

19 Claims, 6 Drawing Sheets

HEADER CONNECTOR ASSEMBLY

BACKGROUND OF THE INVENTION

The subject matter described herein relates generally to electrical connectors, and more particularly, to shielded header connectors.

Transmissions in some automobiles may include a transmission case that has wires extending from the case or a connector joined to the case. The wires may be coupled with other components or the connector may be joined with another connector in the automobile to transfer current to the transmission. The current may be used to shift or change gears in the transmission, or operate a pump of the transmission, for example.

The wires or connectors exit from the transmission case from openings in the case. These openings may need to be sealed in order to prevent contaminants from outside of the transmission case, such as moisture, dirt, and the like, from entering into the transmission case via the openings. Additionally, the openings may need to be sealed to prevent contaminants inside the transmission case, such as transmission fluid, from exiting the transmission case via the openings.

Hybrid and electric automobiles may use relatively high voltage current to power various components in the automobiles, including transmissions. In order to transfer high voltage current to the transmissions in the hybrid or electric automobiles, a shielded connector may be needed. For example, rather than using unshielded wires or connectors to transfer power to the transmissions, a shielded connector may be needed in order to restrict emission of electromagnetic interference from the connector. The addition of an electromagnetic shield to the connector may require a connector housing that is formed of multiple sections or nested portions with a conductive body between the sections or portions. But, providing a connector with multiple sections or portions introduces several interfaces between the sections or portions into the connector. These interfaces may provide pathways for contaminants, such as moisture and transmission fluid, to pass into the interior of the connector. Contaminants that ingress into the connector may short out or otherwise interfere with transfer of the high voltage current through the connector, or may result in transmission fluid in the transmission case leaking out of the transmission case.

A need exists for a header connector having sealing that restricts ingress of contaminants into the connector and/or the passage of contaminants through the connector.

BRIEF DESCRIPTION OF THE INVENTION

In one embodiment, a header connector assembly is provided. The header connector assembly includes an outer housing, an inner housing, a shield subassembly, and a seal body. The outer housing is disposed in an opening of a panel and includes a cavity. The inner housing includes a channel and is disposed in the opening of the panel. The inner housing is received in the cavity of the outer housing and includes a channel configured to have a contact disposed therein. The shield subassembly is disposed between the outer housing and the inner housing. The shield subassembly engages the panel to electrically couple the shield subassembly with the panel. The seal body is disposed between the panel and at least one of the outer housing and the inner housing. The seal body restricts passage of contaminants between the panel and at least one of the outer housing and the inner housing.

In another embodiment, another header connector assembly is provided. The header connector assembly includes a housing subassembly, an electromagnetic shield subassembly, a forward seal body, and a rear seal body. The housing subassembly has a high voltage contact that is configured to engage a conductive member of a connector that mates with the housing subassembly. The shield subassembly is disposed in the housing subassembly and engages a panel to electrically couple the shield subassembly with the panel. The forward seal body is disposed between the shield subassembly and a front side of the panel. The rear seal body is disposed between the shield subassembly and a rear side of the panel. The forward and rear seal bodies seal interfaces between the housing subassembly and the panel on opposite sides of the shield subassembly.

In another embodiment, another header connector assembly is provided. The header connector assembly includes a housing subassembly, a contact, an outer conductive shield, an inner conductive shield, and a seal body. The housing subassembly is disposed in an opening of a panel and includes a channel. The contact is disposed in the channel of the housing subassembly and is configured to engage a conductive member of a connector that mates with the housing subassembly. The outer conductive shield is joined to the housing subassembly and engages the panel along a perimeter of the housing subassembly. The outer conductive shield includes an opening extending therethrough. The inner conductive shield extends through the opening in the outer conductive shield and is electrically coupled with the outer conductive shield. The inner conductive shield defines an interior chamber with the channel of the housing subassembly disposed therein. The seal body is disposed between the panel and the housing subassembly. The seal body restricts passage of contaminants between the panel and the housing subassembly.

DETAILED DESCRIPTION OF THE INVENTION

Figure 1:
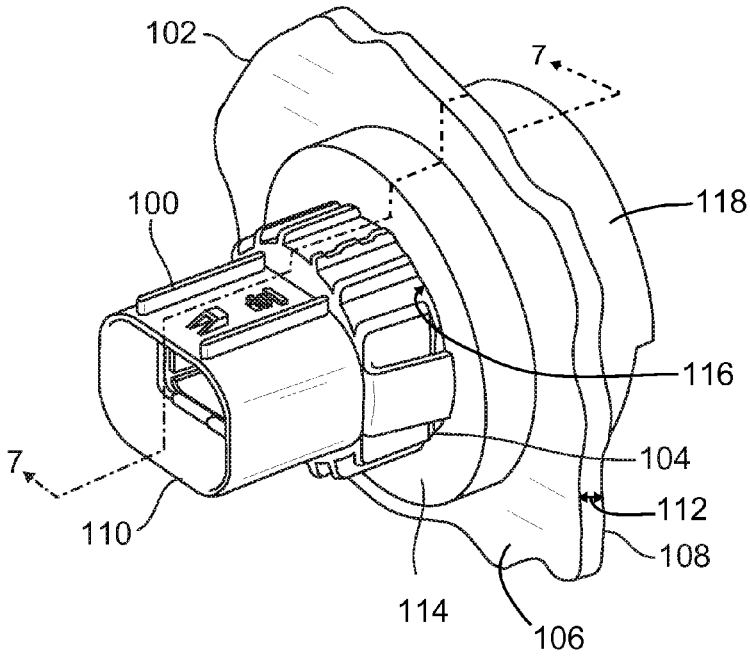
FIG. 1 is a perspective view of a header connector assembly mounted in a panel in accordance with one embodiment of the present disclosure.
Figure 2:
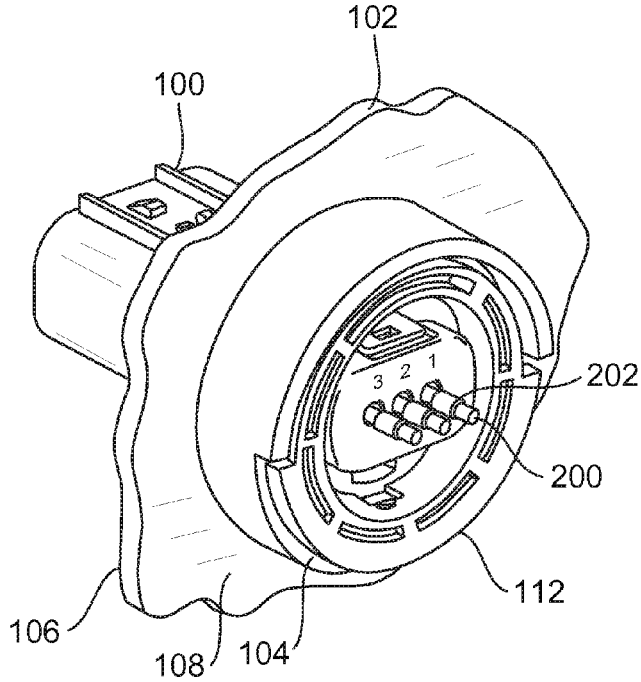
FIG. 2 is another perspective view of the header connector assembly shown in FIG. 1.

FIG. 1 is a perspective view of a header connector assembly 100 mounted in a panel 102 in accordance with one embodiment of the present disclosure. FIG. 2 is another perspective view of the header connector assembly 100. The header connector assembly 100 is mounted to the panel 102 by placing the header connector assembly 100 through an opening 104 in the panel 102. FIG. 1 shows the header connector assembly 100 from a front side 106 of the panel 102 while FIG. 2 shows the header connector assembly 100 from a back side 108 of the panel 102. The header connector assembly 100 extends to a mating end 110 that protrudes from the front side 106 of the panel 102 and to a back end 112 that protrudes from or is disposed near the back side 108 of the panel 102 in the illustrated embodiment.

The header connector assembly 100 mates with a connector 800 (shown in FIG. 8) at the mating end 110 from the front side 106 of the panel 102. Contacts 302 (shown in FIG. 3) in the header connector assembly 100 mate with one or more conductive members 804 (shown in FIG. 8) to electrically join the contacts 302 with the conductive members 804. The contacts 302 are joined with conductors 200 that extend through cables 202 exiting from the back end 112 of the header connector assembly 100. The mating of the header connector assembly 100 with the connector 800 couples the conductive members 804 with the conductors 200 via the contacts 302.

In one embodiment, the panel 102 is a portion of a transmission case in a vehicle, such as a hybrid or electric automobile. The panel 102 may be an exterior surface of the transmission case such that the front side 106 of the panel 102 is exposed to environmental contaminants such as moisture, dirt, and the like while the back side 108 is exposed to internal contaminants such as transmission fluid. The panel 102 may, however, be a portion of a different surface. For example, the panel 102 may represent the exterior surface of an electrical component or other device that communicates power and/or data signals via the header connector assembly 100. The panel 102 has a thickness 112 between the opposite sides 106, 108. In the illustrated embodiment, a flange 114, 118 protrudes from each of the sides 106, 108 of the panel 102 with the opening 104 extending through the panel 102 and encircled by the flanges 114, 118. The portion of the panel 102 that is located within the opening 104 and encircles the header connector assembly 100 in the opening 104 may be referred to as a compression surface 116 of the panel 102. As described below, seal bodies 326, 328 (shown in FIG. 3) of the header connector assembly 100 engage the compression surface 116 within the opening 104 to provide seals against ingress or passage of contaminants. The compression surface 116 may include the interface between the header connector assembly 100 and the panel 102 within the opening 104.

The header connector assembly 100 may be referred to as a pass-through connector or header connector because the header connector assembly 100 provides a conductive pathway between a connector 800 (shown in FIG. 8) on one side 106 of the panel 102 and one or more electronic components on the opposite side 108 of the panel 102. As described below, the header connector assembly 100 may be used in high voltage applications, such as in transferring relatively high voltage currents to the transmission of a high voltage vehicle. In order to protect electronic components from the electromagnetic interference (EMI) generated by the high voltage currents passing through the header connector assembly 100, the header connector assembly 100 includes an electromagnetic shield subassembly 318 (shown in FIG. 3) that restricts emission of the EMI outside of the header connector assembly 100. The shield subassembly 318 is joined with the panel 102 along a perimeter of the header connector assembly 100 to transfer EMI from the header connector assembly 100 to the panel 102. For example, the shield subassembly 318 may engage the compression surface 116 (shown in FIG. 1) of the panel 102 to electrically couple the shield subassembly 318 to the panel 102. EMI may radiate from a contact subassembly 300 (shown in FIG. 3) located within the shield subassembly 318. The shield subassembly 318 may conduct this EMI to the panel 102 to avoid the EMI interfering with other nearby components.

In order for the shield subassembly 318 (shown in FIG. 3) in the header connector assembly 100 to engage the panel 102, the header connector assembly 100 may include openings or gaps through which the shield subassembly 318 extends or protrudes. These openings or gaps can provide pathways for contaminants such as moisture to ingress into the header connector assembly 100 from outside of the panel 102 (such as through the front side 106 of the panel 102) and/or for contaminants such as transmission fluid to ingress into the header connector assembly 100 from behind the panel 102 (such as through the back side 108 of the panel 102). As described below, in order to restrict ingress of contaminants into the header connector assembly 100, seal bodies 326, 328 (shown in FIG. 3) are placed at interfaces between the header connector assembly 100 and the panel 102 on both sides of the perimeter of the header connector assembly 100 where the shield subassembly 318 engages the panel 102. The seal bodies 326, 328 restrict passage of contaminants into the header connector assembly 100 from the front and back sides 106, 108 of the panel 102.

Figure 3:
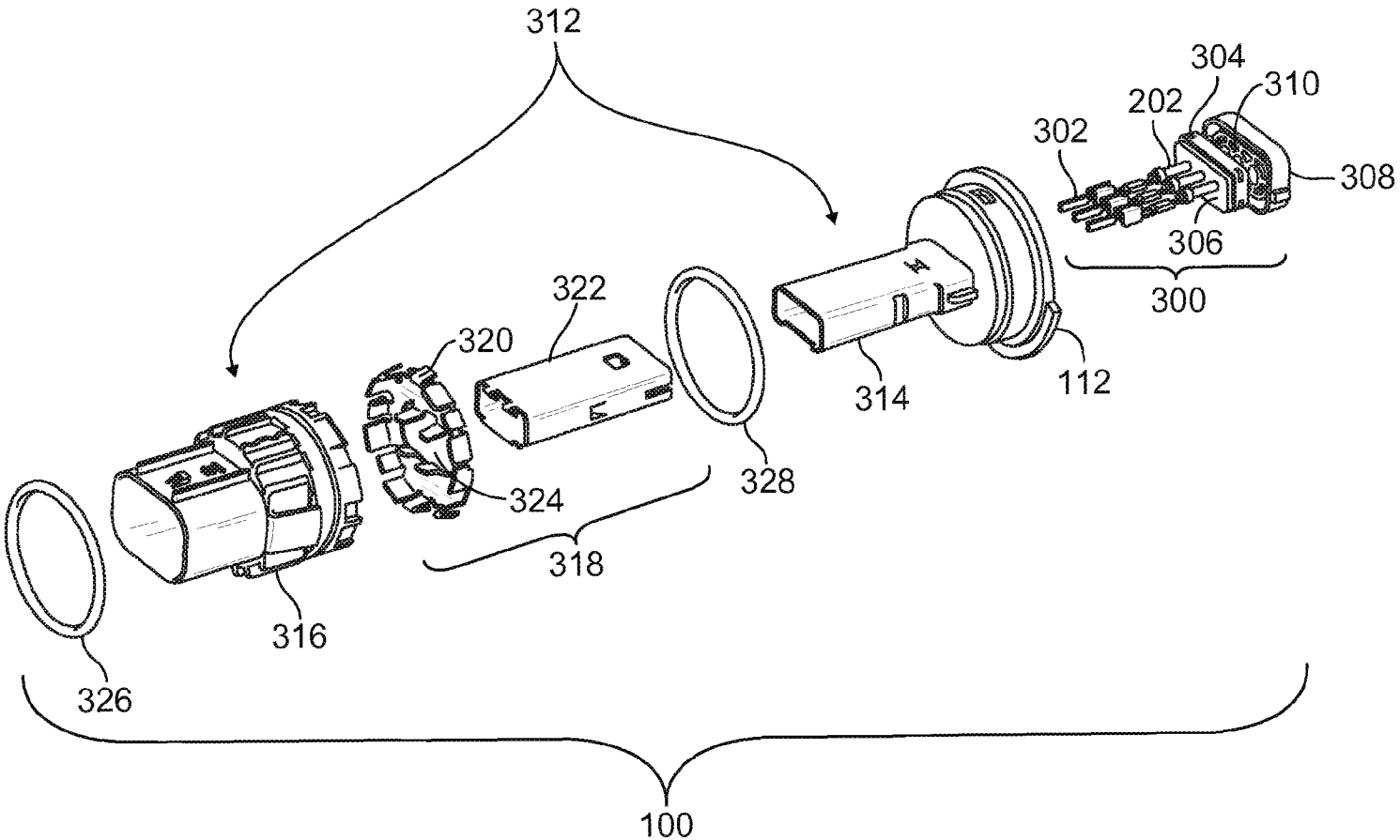
FIG. 3 is an exploded view of the header connector assembly shown in FIG. 1 in accordance with one embodiment of the present disclosure.

FIG. 3 is an exploded view of the header connector assembly 100 in accordance with one embodiment of the present disclosure. The header connector assembly 100 includes a contact subassembly 300. The contact subassembly 300 shown in FIG. 3 has three contacts 302, although a different number of contacts 302 may be provided. The contacts 302 are joined with the conductors 200 (shown in FIG. 2) that extend through the cables 202. The cables 202 extend through openings 306 in a cable seal 304. A cable seal retainer 308 secures the cable seal 304 within the header connector assembly 100. The cable seal retainer 308 includes openings 310 through which the cables 202 extend to exit the back end 112 of the header connector assembly 100. The cable seal 304 surrounds the cables 202 within the cable seal retainer 308 to prevent the ingress of contaminants into the header connector assembly 100 through the openings 310 in the cable seal retainer 308 and the openings 306 in the cable seal 304.

The header connector assembly 100 includes a housing subassembly 312. In the illustrated embodiment, the housing subassembly 312 includes an inner housing 314 that is joined to an outer housing 316. While the inner and outer housings 314, 316 are shown and described herein as separate bodies, alternatively, the inner and outer housings 314, 316 may be formed as a single, unitary body. As described below, the inner housing 314 extends into the outer housing 316 and the contacts 302 are disposed within the inner housing 314. The inner and outer housings 314, 316 are described in more detail below in connection with FIG. 4.

The shield subassembly 318 includes an outer conductive shield 320 joined with an inner conductive shield 322. While the outer and inner conductive shields 320, 322 are shown and described herein as separate bodies, alternatively, the outer and inner conductive shields 320, 322 may be formed as a single, unitary body. As described below, the outer conductive shield 320 engages the panel 102 (shown in FIG. 1) along an outer perimeter of the housing subassembly 312 within the opening 104 of the panel 102. The outer conductive shield 320 is disposed between the outer housing 316 and the inner housing 314 of the housing subassembly 312. A portion of the inner housing 314 is located within the inner conductive shield 322. For example, the portion of the inner housing 314 that includes the contacts 302 is disposed within the portion of the inner housing 314 that is located within the inner conductive shield 322. The outer conductive shield 320 includes an opening 324 through which the inner conductive shield 322 extends. The inner conductive shield 322 restricts emission of EMI generated from the contact subassembly 300 located within the inner housing 314. The EMI is transferred to the outer conductive shield 320 from the inner conductive shield 322. The outer conductive shield 320 is coupled with the panel 102 to transfer the energy of the EMI to the panel 102. The inner and outer conductive shields 322, 320 are described in more detail below in connection with FIG. 5.

The header connector assembly 100 shown in FIG. 3 includes a forward seal body 326 and a rear seal body 328. The seal bodies 326, 328 are elastomeric members that may be compressed between two components to provide a seal at the interface between the components. For example, the seal bodies 326, 328 may be O-ring gaskets or potting compounds placed around outer perimeters of the outer and inner housings 316, 314. The forward seal body 326 may be compressed between the outer housing 316 and the panel 102 (shown in FIG. 1) inside the opening 104 (shown in FIG. 1) in the panel 102 to restrict passage of moisture through the interface between the outer housing 316 and the panel 102. The rear seal body 328 may be compressed between the inner housing 314 and the panel 102 inside the opening 104 to restrict passage of transmission fluid through the interface between the inner housing 314 and the panel 102.

Figure 4:
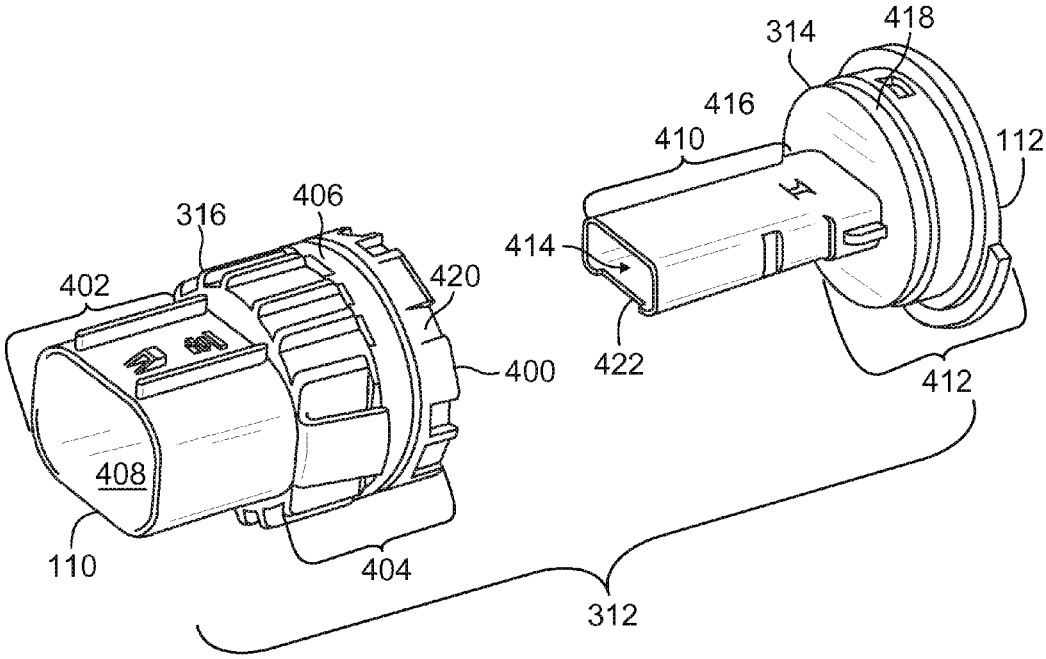
FIG. 4 is a perspective view of a housing subassembly shown in FIG. 3 in accordance with one embodiment of the present disclosure.

FIG. 4 is a perspective view of the housing subassembly 312 in accordance with one embodiment of the present disclosure. The outer housing 316 and the inner housing 314 may include, or be formed from, a dielectric material, such as one or more polymers. The outer housing 316 has an elongated body that extends from the mating end 110 to an interface end 400. A cavity 408 extends through the outer housing 316 from the mating end 110 to the interface end 400. A forward portion 402 of the outer housing 316 includes the mating end 110 and forms a shroud around the contacts 302 (shown in FIG. 3) of the contact subassembly 300 (shown in FIG. 3). The connector 800 (shown in FIG. 8) mates with the mating end 110 of the outer housing 316.

A back portion 404 of the outer housing 316 extends from the forward portion 402 to the interface end 400. The back portion 404 has an approximate cylindrical or tubular shape in order to fit within the approximately circular opening 104 (shown in FIG. 1) of the panel 102 (shown in FIG. 1). For example, a section of the back portion 404 may be located within the thickness 112 (shown in FIG. 1) of the panel 102. The back portion 404 may have a different shape if the opening 104 is different from that shown in FIG. 1. A groove 406 extends around an outer perimeter of the outer housing 316 in the back portion 404. The front seal body 326 (shown in FIG. 3) is held in the groove 406 between the outer housing 316 and the compression surface 116 (shown in FIG. 1) of the panel 102. In one embodiment, the back portion 404 is partially disposed in the opening 104 of the panel 102 such that the forward portion 402 and a section of the back portion 404 projects from the front side 106 (shown in FIG. 1) of the panel 102 while the remainder of the back portion 404 is disposed within the thickness 112 of the panel 102.

In the illustrated embodiment, the back portion 404 includes recesses 420 disposed along the outer periphery of the back portion 404 at the interface end 400. The recesses 420 receive retention fingers 502 (shown in FIG. 5) and spring fingers 504 (shown in FIG. 5) of the outer conductive shield 320 (shown in FIG. 3) to secure the outer conductive shield 320 to the outer housing 316.

The inner housing 314 has an elongated body that extends from a front end 422 to the back end 112. The inner housing 314 includes a forward portion 410 joined to a back portion 412. The forward portion 410 extends from the front end 422 to an interface end 416. The back portion 412 extends from the interface end 416 to the back end 112. A channel 414 extends through the inner housing 314 from the front end 422 to the back end 112. The contacts 302 (shown in FIG. 3) are disposed in the channel 414. In the illustrated embodiment, the forward potion 410 has an approximate rectangular cross-sectional shape, while the back portion 412 has an approximate cylindrical or tubular shape. Alternatively, the forward and/or back portions 410, 412 may have different shapes. The back portion 412 may have the cylindrical or tubular shape so that the back portion 412 fits within the circular opening 104 (shown in FIG. 1). The shape of the back portion 412 may change if the shape of the opening 104 is different from the shape shown in FIG. 1.

The inner housing 314 is joined with the outer housing 316 such that the forward portion 410 of the inner housing 314 extends into the cavity 408 in the forward portion 402 of the outer housing 316. As described below, the outer conductive shield 320 is disposed between the interface end 416 of the inner housing 314 and the interface end 400 of the outer housing 316. The inner conductive shield 322 partially encloses the forward portion 410 of the inner housing 314 and is disposed between the forward portion 410 of the inner housing 314 and the outer housing 316 inside the cavity 408 of the outer housing 316.

A groove 418 extends around an outer perimeter of the inner housing 314 in the back portion 412. The rear seal body 328 (shown in FIG. 3) is held in the groove 418 between the inner housing 314 and the panel 102 (shown in FIG. 1) within the opening 104 (shown in FIG. 1) of the panel 102. In one embodiment, the back portion 412 is at least partially disposed in the opening 104 of the panel 102 such that the back portion 412 does not extend beyond or protrude from the back side 108 (shown in FIG. 1) of the panel 102.

Figure 5:
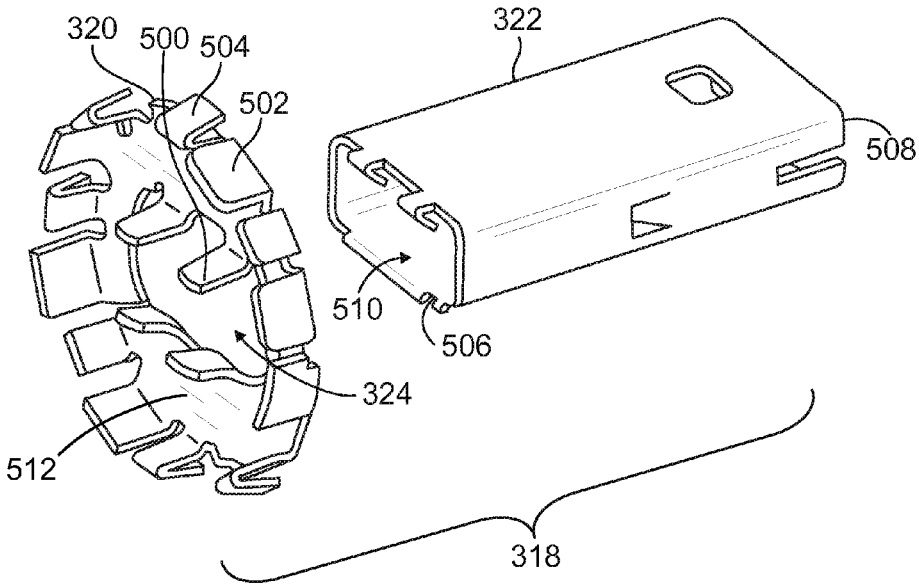
FIG. 5 is a perspective view of a shield subassembly shown in FIG. 3 in accordance with one embodiment of the present disclosure.

FIG. 5 is a perspective view of the shield subassembly 318 in accordance with one embodiment of the present disclosure. The outer conductive shield 320 of the shield subassembly 318 may be stamped and formed from a common sheet of a conductive material, such as a metal or metal alloy. In the illustrated embodiment, the outer conductive shield 320 has an approximately planar body 512 that is in the shape of a circle. The outer conductive shield 320 may have the circular shape so that the outer conductive shield 320 has the same shape as, and fits within, the circular opening 104 (shown in FIG. 1) of the panel 102 (shown in FIG. 1). Alternatively, the outer conductive shield 320 may have a different shape.

The outer conductive shield 320 includes cantilevered beams 500 that protrude from one side of the outer conductive shield 320 from the perimeter of the opening 324 in the outer conductive shield 320. Alternatively, the beams 500 may not be cantilevered and/or the beams 500 may extend from a different side of the outer conductive shield 320. The beams 500 engage the inner conductive shield 322 when the inner conductive shield 322 is inserted through the opening 324. The beams 500 engage the inner conductive shield 322 to electrically couple the outer and inner conductive shields 320, 322. For example, when the inner conductive shield 322 is placed into the opening 324, the beams 500 may be biased outward and away from the opening 324 by the inner conductive shield 322. The outwardly biased beams 500 may then apply a force on the inner conductive shield 322 that maintains contact between the beams 500 and the inner conductive shield 322.

In the illustrated embodiment, the outer conductive shield 320 includes the retention fingers 502 and the spring fingers 504 around the periphery of the outer conductive shield 320. The retention fingers 502 are extensions or cantilevered beams of the outer conductive shield 320 that secure the outer conductive shield 320 to the outer housing 316 (shown in FIG. 3). As described above, the outer housing 316 includes recesses 420 (shown in FIG. 4) that receive the retention fingers 502. The retention fingers 502 may be outwardly biased when the outer conductive shield 320 is joined to the outer housing 316 and the retention fingers 502 are received in the recesses 420. The biasing of the retention fingers 502 may prevent the outer conductive shield 320 from being separated from the outer housing 316.

The spring fingers 504 are extensions of the outer conductive shield 320 that engage the panel 102 (shown in FIG. 1) inside the opening 104 (shown in FIG. 1) of the panel 102 to electrically couple the shield subassembly 318 to the panel 102. As shown in FIG. 5, the spring fingers 504 may be cantilevered beams that are folded back to provide a resiliency. For example, the spring fingers 504 may be folded back such that the spring fingers 504 are compressed when the shield subassembly 318 is loaded into the opening 104 of the panel 102 and the spring fingers 504 engage the compression surface 116 (shown in FIG. 1) of the panel 102. The compression of the spring fingers 504 can cause the spring fingers 504 to exert an outward force on the compression surface 116 of the panel 102 such that the spring fingers 504 maintain contact, and thus an electrical coupling, with the panel 102. Alternatively, the spring fingers 504 may have a different shape or orientation. For example, the spring fingers 504 may not be folded back or may not be cantilevered beams.

The inner conductive shield 322 has an elongated body that extends between opposite ends 506, 508. The inner conductive shield 322 has a shape that compliments or corresponds to the shape of the forward portion 410 (shown in FIG. 4) of the inner housing 314 (shown in FIG. 3). For example, the inner conductive shield 322 has an approximate rectangular cross-sectional shape, but alternatively may have a different shape. The inner conductive shield 322 forms an interior chamber 510 that extends from one end 506 to the opposite end 508. The forward portion 410 of the inner housing 314 is loaded into the interior chamber 510.

Figure 6:
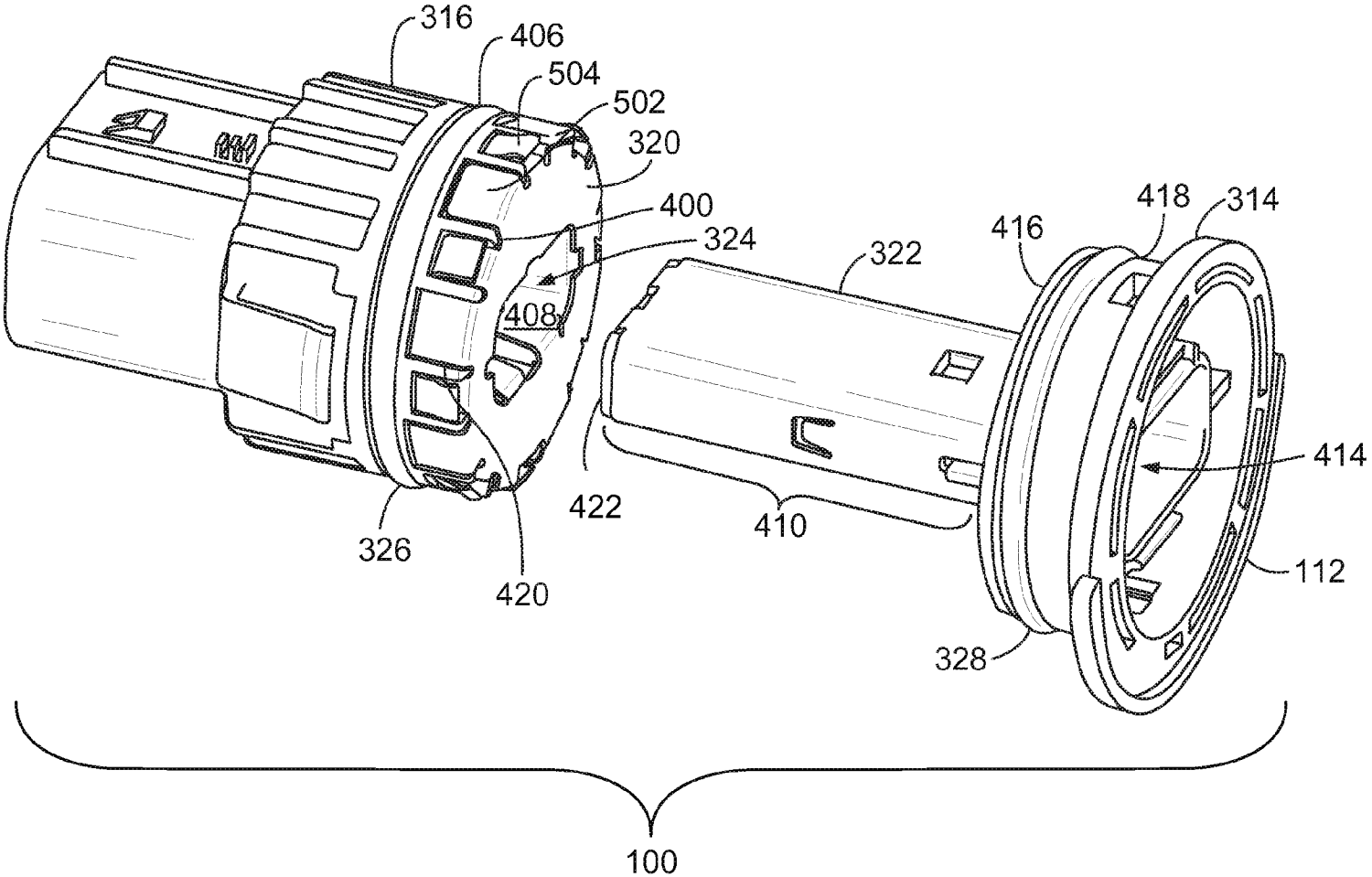
FIG. 6 is another exploded view of the header connector assembly shown in FIG. 1 in accordance with one embodiment of the present disclosure.

FIG. 6 is another exploded view of the header connector assembly 100 in accordance with one embodiment of the present disclosure. As shown in FIG. 6, the outer conductive shield 320 is coupled to the interface end 400 of the outer housing 316. The retention fingers 502 and the spring fingers 504 of the outer conductive shield 320 are received in the recesses 420 of the outer conductive shield 320. The inner conductive shield 322 is joined to the forward portion 410 of the inner housing 314 by loading the forward portion 410 into the inner conductive shield 322. The inner conductive shield 322 surrounds the forward portion 410 while leaving the channel 414 (shown in FIG. 4) of the inner housing 314 open at the front end 422 of the inner housing 314. The forward seal body 326 is placed in the groove 406 of the outer housing 316 while the rear seal body 328 is placed in the groove 418 of the inner housing 314.

The inner and outer conductive shields 322, 320 are disposed at interfaces between and separate the inner and outer housings 314, 316 from one another. For example, the inner conductive shield 322 and the forward portion 410 of the inner housing 314 may be loaded into the cavity 408 of the outer housing 316 through the opening 324 in the outer conductive shield 320. In one embodiment, the inner conductive shield 322 and inner housing 314 are loaded into the outer housing 316 until the interface end 416 of the inner housing 314 engages the outer conductive shield 320. For example, the outer conductive shield 320 may be sandwiched between the interface end 400 of the outer housing 316 and the interface end 416 of the inner housing 314. In such a position, the outer conductive shield 320 separates and is disposed at an interface between the outer and inner housings 316, 314. The inner conductive shield 322 is located within the outer housing 316 and separates the outer housing 316 from the inner housing 314 within the outer housing 316.

The contact subassembly 300 (shown in FIG. 3) may be loaded into the channel 414 of the inner housing 314 through the back end 112 of the inner housing 314. As shown in FIG. 6, the channel 414 is accessible through the back end 112. The contact subassembly 300 may be loaded into the channel 414 until the cable seal retainer 308 (shown in FIG. 3) is joined with the inner housing 314 to secure the other components of the contact subassembly 300 in the channel 414.

Figure 7:
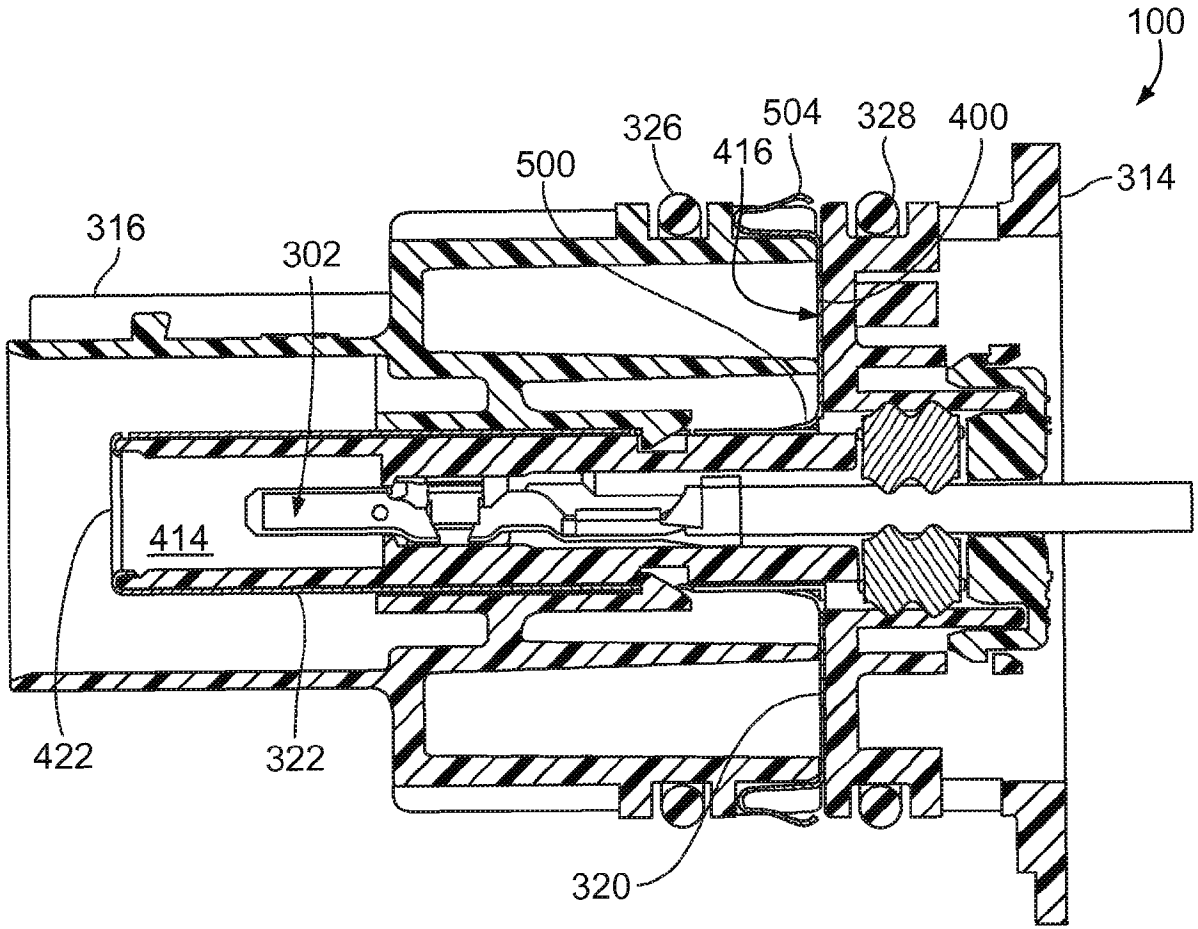
FIG. 7 is a cross-sectional view of the header connector assembly shown in FIG. 1 without the panel taken along line 7-7 in FIG. 1 in accordance with one embodiment of the present disclosure.

FIG. 7 is a cross-sectional view of the header connector assembly 100 without the panel 102 (shown in FIG. 1) taken along line 7-7 shown in FIG. 1 in accordance with one embodiment of the present disclosure. As shown in FIG. 7, the inner and outer conductive shields 322, 320 are oriented generally perpendicular to one another. For example, the outer conductive shield 320 is generally oriented along a vertical plane while the inner conductive shield 320 is generally oriented along or parallel to a horizontal plane. The inner and outer conductive shields 322, 320 are disposed at the interfaces between and separate the inner and outer housings 314, 316. The inner and outer conductive shields 322, 320 are electrically joined with one another by the contact between the beams 500 of the outer conductive shield 320 and the inner conductive shield 322. The spring fingers 504 of the outer conductive shield 320 project from the outer periphery of the header connector assembly 100 such that the spring fingers 504 engage and may be compressed by the panel 102 (shown in FIG. 1) inside the opening 104 (shown in FIG. 1) of the panel 102. The engagement between the spring fingers 504 and the panel 102 couples the inner conductive shield 322 with the panel 102 via the outer conductive shield 320. The contacts 302 are disposed within the channel 414 of the inner housing 314 such that, except for the open front end 422 of the inner housing 314, the contacts 302 are enclosed within the inner conductive shield 322.

In use, electromagnetic interference (EMI) emanates from or is generated by current flowing through the contacts 302. The inner conductive shield 322 surrounds the contacts 302 to provide EMI shielding around the contacts 302. EMI radiating from the contacts 302 is shielded from exiting the header connector assembly 100 by the inner conductive shield 322. The outer conductive shield 320 is electrically coupled to the inner conductive shield 322 such that the EMI from the contacts 302 is transferred from the inner conductive shield 322 to the outer conductive shield 320. The outer conductive shield 320 may engage the compression surface 116 (shown in FIG. 1) of the panel 102 to transfer the EMI to the panel 102.

Figure 8:
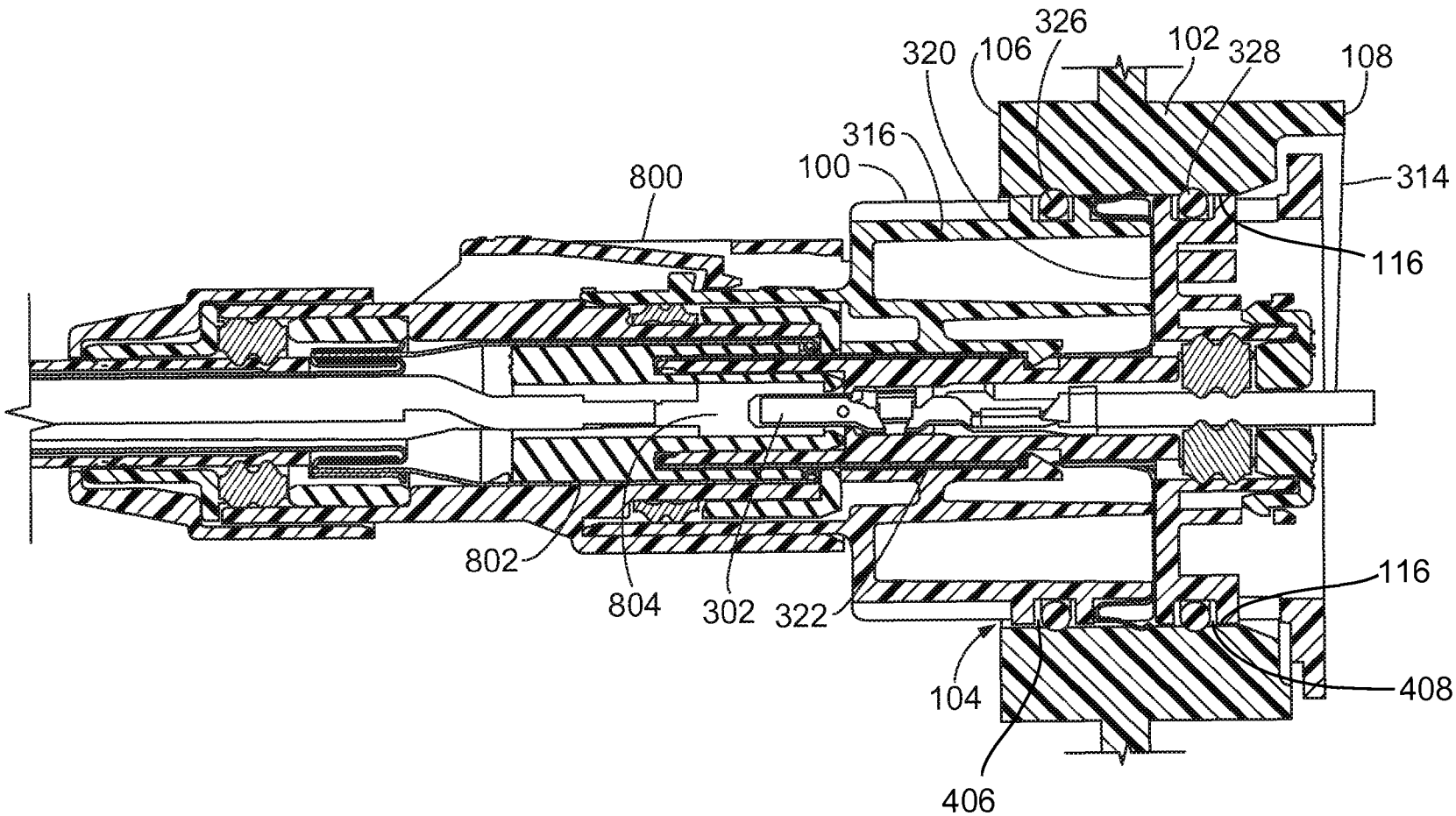
FIG. 8 is another cross-sectional view of the header connector assembly shown in FIG. 1 taken along line 7-7 in FIG. 1 in accordance with one embodiment of the present disclosure.

FIG. 8 is another cross-sectional view of the header connector assembly 100 taken along line 7-7 shown in FIG. 1 in accordance with one embodiment of the present disclosure. FIG. 8 shows the header connector assembly 100 mounted in the opening 104 of the panel 102 and mated with a connector 800. The connector 800 mates with the header connector assembly 100 to transfer current between the connector 800 and the header connector assembly 100. By way of example only, the connector 800 may be similar to the connector assembly shown and described as a plug connector subassembly 2 in U.S. patent application Ser. No. 12/539,261, filed Aug. 11, 2009, and entitled "Connector Assembly With Two Stage Latch." Other types or different connectors 800, however, may be used to mate with the header connector assembly 100. The connector 800 engages the outer housing 316 to mate conductive members 804 of the connector 800 with the contacts 302 of the header connector assembly 100.

The forward and rear seal bodies 326, 328 assist in restricting transmission of contaminants, such as moisture or transmission fluid, into the header connector assembly 100 or through the opening 104 in the panel 102 from one side 106, 108 to the other side 106, 108 of the panel 102. The forward and rear seal bodies 326, 328 are located on opposite sides of the outer conductive shield 320 to prevent ingress of contaminants from both sides 106, 108 of the panel 102 from passing into the header connector assembly 100 along the outer conductive shield 320 and/or the inner conductive shield 322.

The forward seal body 326 may be compressed between the outer housing 316 and the compression surface 116 of the panel 102 to seal an interface between the header connector assembly 100 and the panel 102. This seal restricts ingress of contaminants coming from the front side 106 of the panel 102 from passing through the interface between the outer housing 316 and the panel 102 and into the interface between the outer housing 316 and the inner housing 314. For example, the forward seal body 326 may prevent moisture from outside of a transmission case from passing into the interior of the header connector assembly 100 via the interfaces between the outer housing 316 and the panel 102 and between the interface ends 400, 416 of the outer and inner housings 316, 314.

The rear seal body 328 may be compressed between the outer housing 316 and the compression surface 116 of the panel 102 to seal an interface between the header connector assembly 100 and the panel 102. This seal restricts ingress of contaminants coming from the rear side 108 of the panel 102 from passing through the interface between the inner housing 314 and the panel 102 and into the interface between the outer housing 316 and the inner housing 314. For example, the forward seal body 326 may prevent transmission fluid from passing into the interior of the header connector assembly 100 via the interfaces between the inner housing 314 and the panel 102 and between the interface ends 400, 416 of the outer and inner housings 316, 314.

The forward and rear seal bodies 326, 328 are shown and described herein as separate bodies. Alternatively, the forward and rear seal bodies 326, 328 may be formed as a single, unitary body. For example, a single seal body may be disposed in each of the grooves 406, 418 (shown in FIG. 4) and extend from one groove 406 to the other groove 418 between the panel 102 and the inner and outer housings 314, 316. Such a single seal body may include one or more openings that permit the outer conductive shield 320 to extend therethrough and contact the panel 102 inside the opening 104 in order to electrically join the shield subassembly 318 with the panel 102.

The outer conductive shield 320 engages the compression surface 116 of the panel 102 between the forward and rear seal bodies 326, 328 such that the forward seal body 326 seals an interface between the outer conductive shield 320 and the front side 106 of the panel 102 while the rear seal body 328 seals an interface between the outer conductive shield 320 and the rear side 108 of the panel 102. The inner conductive shield 322 encloses the contacts 302 and may engage a conductive shield 802 of the connector 800 to restrict emission of electromagnetic interference from the contacts 302 or conductive members 804 of the connector 800. For example, the electromagnetic interference emanating from or generated by the contacts 302 or conductive members 804 may be transferred to the panel 102 by the inner and outer conductive shields 322, 320.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A header connector assembly comprising:

an outer housing configured to be disposed in an opening of a panel, the outer housing including a cavity;

an inner housing received in the cavity of the outer housing, the inner housing configured to be disposed in the opening of the panel, the inner housing including a channel configured to have a contact disposed therein;

a shield subassembly disposed between the outer housing and the inner housing, the shield subassembly configured to engage the panel and electrically couple the shield subassembly with the panel, the shield subassembly comprising an outer conductive shield and an inner conductive shield electrically coupled with one another, the outer conductive shield including an opening through which the inner conductive shield extends; and a forward seal body configured to be disposed between the panel and the outer housing, wherein the forward seal body restricts passage of contaminants between the panel and the at least one of the outer housing or the inner housing.

2. The header connector assembly of claim 1, wherein the forward seal body restricts ingress of the contaminants into an interface between the header connector assembly and the panel with the shield subassembly engaging the interface.

3. The header connector assembly of claim 1, further comprising a rear seal body configured to be disposed between the inner housing and the panel.

4. The header connector assembly of claim 3, wherein the forward seal body restricts ingress of one or more of the contaminants through an interface between the panel and the outer housing from a front side of the panel and the rear seal body restricts ingress of one or more of the contaminants through an interface between the panel and the inner housing from a rear side of the panel.

5. The header connector assembly of claim 3, wherein the forward seal body is configured to be disposed between the shield subassembly and a front side of the panel and the rear seal body is configured to be disposed between the shield subassembly and a back side of the panel.

6. The header connector assembly of claim 1, wherein the outer conductive shield of the shield subassembly is configured to be electrically coupled with the and the inner conductive shield of the shield subassembly is disposed between the inner housing and the outer housing within the cavity of the outer housing.

7. The header connector assembly of claim 1, wherein the outer conductive shield of the shield subassembly is oriented perpendicular to the inner conductive shield of the shield subassembly.

8. A header connector assembly comprising:

a housing subassembly having a high voltage contact disposed in the housing subassembly that is configured to engage a conductive member of a connector that mates with the housing subassembly;

an electromagnetic shield subassembly disposed in the housing subassembly, the shield subassembly configured to engage a panel and electrically couple the shield subassembly with the panel;

a forward seal body configured to be disposed between the shield subassembly and a front side of the panel; and a rear seal body configured to be disposed between the shield subassembly and a rear side of the panel, wherein the forward and rear seal bodies seal interfaces between the housing subassembly and the panel on opposite sides of the shield subassembly.

9. The header connector assembly of claim 8, wherein the forward seal body restricts ingress of one or more contaminants through the interface between the panel and the housing subassembly from a front side of the panel.

10. The header connector assembly of claim 8, wherein the rear seal body restricts ingress of one or more contaminants through the interface between the panel and the housing subassembly from a rear side of the panel.

11. The header connector assembly of claim 8, wherein the housing subassembly includes an outer housing and an inner housing, at least a portion of the outer housing disposed between the shield subassembly and a front side of the panel, at least a portion of the inner housing disposed between the shield subassembly and a back side of the panel.

12. The header connector assembly of claim 8, wherein the housing subassembly includes an outer housing having a cavity and an inner housing having the channel, the inner housing extending into the cavity with the shield subassembly separating the outer housing from the inner housing.

13. The header connector assembly of claim 8, wherein the housing subassembly includes an outer housing having a cavity and an inner housing extending into the cavity, the shield subassembly disposed at an interface between the outer housing and the inner housing, further wherein the seal body restricts ingress of the contaminants into the interface.

14. The header connector assembly of claim 8, wherein the shield subassembly comprises an outer conductive shield and an inner conductive shield electrically coupled with one another, the outer conductive shield including an opening through which the inner conductive shield extends.

15. The header connector assembly of claim 8, wherein the shield subassembly comprises an outer conductive shield and an inner conductive shield electrically joined with one another, the outer conductive shield configured to be electrically coupled with the panel, the inner conductive shield defining an interior chamber with the contact disposed in the interior chamber.

16. A header connector assembly comprising:

a housing subassembly configured to be disposed in an opening of a panel, the housing subassembly including a channel;

a contact disposed in the channel of the housing subassembly and configured to engage a conductive member of a connector that mates with the housing subassembly;

an outer conductive shield joined to the housing subassembly and configured to engage the panel along a perimeter of the housing subassembly, the outer conductive shield including an opening extending therethrough;

an inner conductive shield extending through the opening in the outer conductive shield and electrically coupled with the outer conductive shield, the inner conductive shield defining an interior chamber with the channel of the housing subassembly disposed therein; and a seal body configured to be disposed between the panel and the housing subassembly, wherein the seal body restricts passage of contaminants between the panel and the housing subassembly.

17. The header connector assembly of claim 16, wherein the seal body is a forward seal body configured to be disposed between the outer conductive shield and a front side of the panel when the outer conductive shield engages the panel, further comprising a rear seal body configured to be disposed between the outer conductive shield and a rear side of the panel when the outer conductive shield engages the panel, the forward and rear seal bodies sealing interfaces between the housing subassembly and the panel on opposite sides of the outer conductive shield.

18. The header connector assembly of claim 16, wherein the housing subassembly includes an outer housing having a cavity and an inner housing extending into the cavity, the outer conductive shield and the inner conductive shield disposed at interfaces between the outer housing and the inner housing, further wherein the seal body restricts ingress of the contaminants into the interfaces.

19. The header connector assembly of claim 16, wherein the housing subassembly includes an outer housing and an inner housing, at least a portion of the outer housing disposed between the outer conductive shield and a front side of the panel, at least a portion of the inner housing disposed between the outer conductive shield and a back side of the panel.

* * * * *